US005427555A

United States Patent [19]

Merten

[11] Patent Number: 5,427,555

[45] **Date of Patent: * Jun. 27, 1995**

[54] POWER STEERING SYSTEM

[75] Inventor: Timothy W. Merten, Winnebago County, Wis.

[73] Assignee: Performance 1 Marine, Inc., Overland Park, Kans.

[ * ] Notice: The portion of the term of this patent subsequent to Jul. 20, 2010 has been disclaimed.

[21] Appl. No.: 12,552

[22] Filed: Feb. 2, 1993

[51] Int. Cl.[6] ..... B63H 21/26

[52] U.S. Cl. ..... 440/61; 114/154; 440/62

[58] Field of Search ..... 440/61, 62; 114/150, 114/154, 155, 156, 157, 158, 159, 160, 161

[56] References Cited

U.S. PATENT DOCUMENTS

| | | | |
|---|---|---|---|
| 548,289 | 10/1895 | Bonner | 114/160 |
| 576,231 | 2/1897 | Schofield | 114/150 |
| 815,266 | 3/1906 | Cooper | 114/150 |
| 907,252 | 12/1908 | Leonard | 114/150 |
| 4,531,921 | 7/1985 | Teraura et al. | 114/154 |
| 5,228,405 | 7/1993 | Merten | 440/61 |

FOREIGN PATENT DOCUMENTS

| | | | |
|---|---|---|---|
| 1133061 | 3/1957 | France . | |
| 11365 | 12/1923 | Netherlands | 114/150 |
| 2159483 | 12/1985 | United Kingdom . | |

*Primary Examiner*—Michael S. Huppert
*Assistant Examiner*—Thomas J. Brahan
*Attorney, Agent, or Firm*—R. Jonathan Peters

[57] ABSTRACT

The invention is to a power steering system for a marine vehicle having an operator actuable steering helm and a propulsion unit, including a steering arm, to effect steering movement thereof about a steering axis. The system is interposed between the steering helm and the propulsion unit and mounted remote from the propulsion unit, and further is hydraulically actuated in response to operative movement at the steering helm. A gear drive means, actuated in response to steering actuation at the helm, is operably connected to power steering assist means, comprising a hydraulic cylinder-piston assembly and hydraulic fluid source. Actuating means for regulating the flow of hydraulic fluid through the power steering assist means is operably connected to the gear drive means. An actuable output means, preferably a gear output means is operably connected to the power steering assist means for operative movement in response to the actuating means. An actuable steering means, such as a mechanical push-pull cable, is operably connected to the gear output means and to the steering arm for overcoming torque on the propulsion unit relative to the steering axis for effecting common movement of the steering member in response to steering actuation at the steering helm to pivot the propulsion unit about the steering axis.

33 Claims, 9 Drawing Sheets

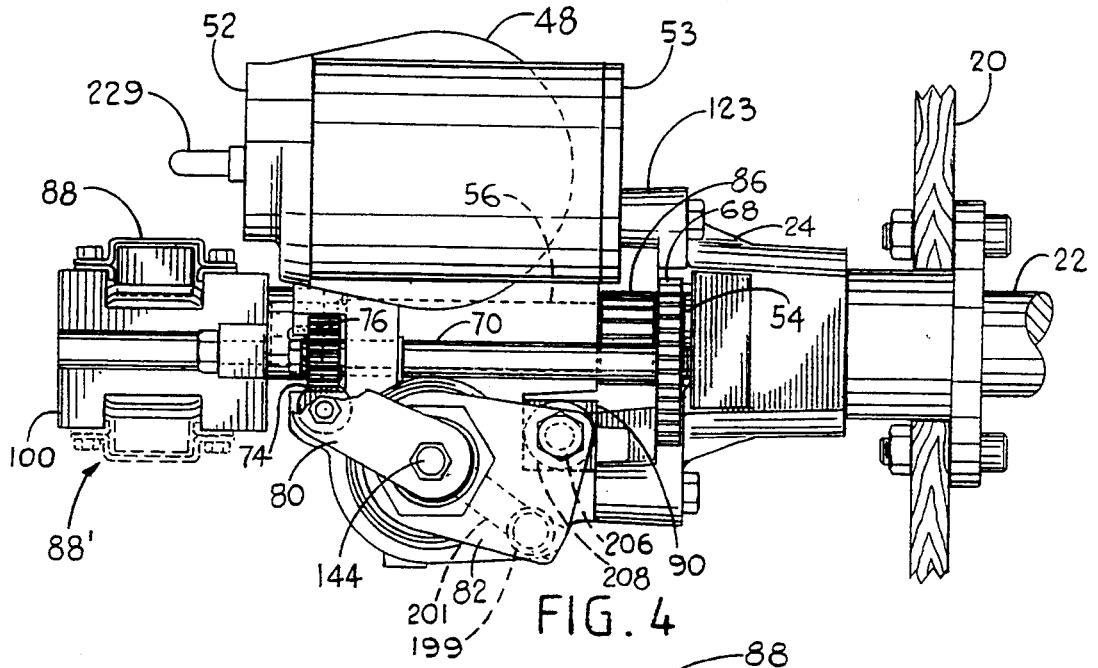
FIG. 4
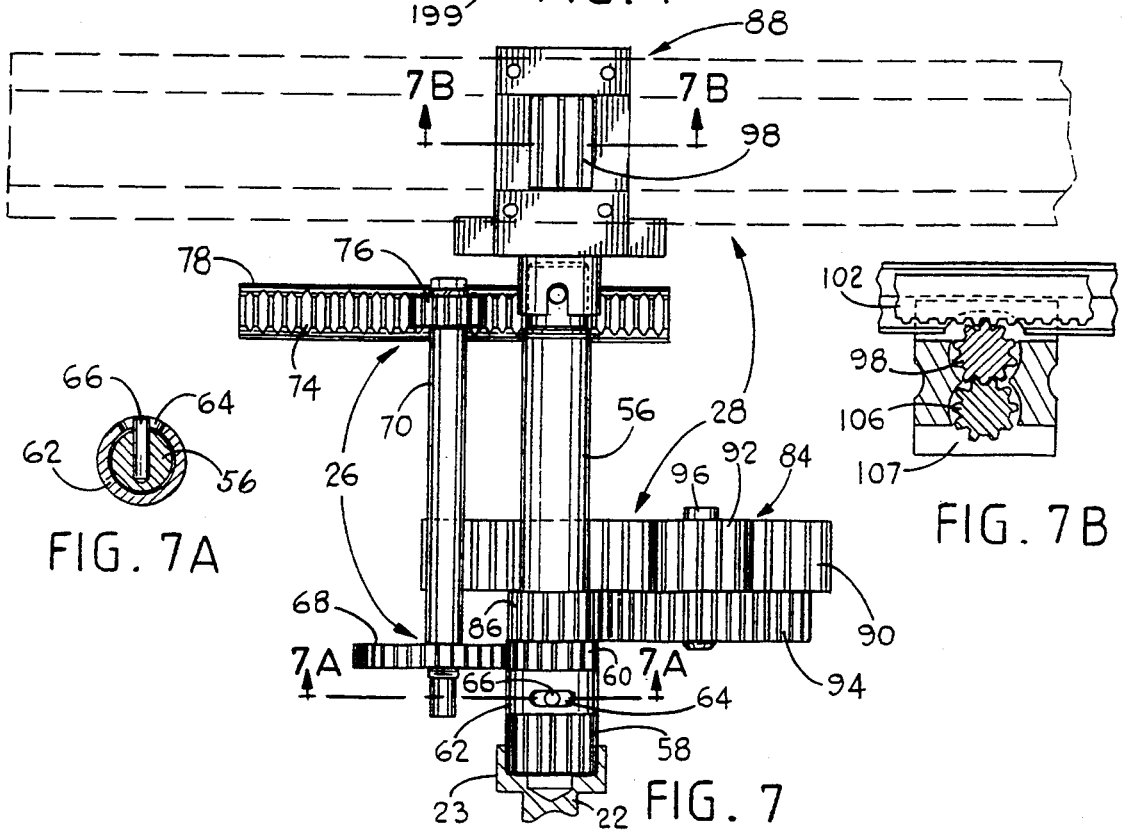
FIG. 7A
FIG. 7B
FIG. 7

POWER STEERING SYSTEM

FIELD OF THE INVENTION

This invention relates to a power steering system. In its more specific aspect, this invention relates to a power steering system, particularly for marine vehicles, utilizing gear means for operative movement in response to turning at the steering helm.

BACKGROUND OF THE INVENTION

In a conventional steering system such as for outboard motors used on boats, the propulsion unit having a stern drive, mounted on the transom of the boat, is pivoted about a vertical steering axis upon steering actuation by the operator at the helm. One typical steering system for a boat having a stern drive comprises a steering cable extending between the steering helm and the propulsion unit so that steering at the helm actuates the cable for causing steering movement of the propulsion unit about a steering axis. A conventional steering cable is the push-pull cable comprising a reciprocative inner core slidable in a protective, flexible outer sheath or housing. One end of the cable is actuably connected to the steering helm, and the other end is actuably connected to the steering mechanism of the propulsion unit. When the wheel is turned at the helm, the cable is actuated by a push-pull movement of the inner core, thereby causing a steering movement of the propulsion unit. Hydraulic activated steering means can be used in place of the cable steering, wherein hydraulic fluid, e.g. oil, is pumped from the steering helm through conduits to a cylinder-piston control means in response to rotation of the steering wheel in one direction or the other. Actuation of the control means actuates the steering mechanism of the propulsion unit, thereby turning the propulsion unit in a common direction.

Prior art teaching steering systems of this type include the following U.S. Pat. Nos. 4,592,732; 4,615,290; 4,632,049; 4,568,292; 4,295,833; and 5,074,193; and French patent 1,133,061. Additionally, British Patent Application 2,159,483A discloses a power steering system for an outboard having a hydraulic cylinder-piston assembly and a control valve which is operated by an actuator including a push-pull cable to selectively extend and retract the piston rod and effect steering of the propulsion unit. The power steering assist system as taught in each of the prior art patents and British application identified above, however, is mounted onto and supported by the propulsion unit. Mounting the power steering system on the propulsion unit is disadvantageous for a number of reasons. First, the propulsion unit mounting position must be changed because there is a steering apparatus to conflict with the boat transom design during verticle tilt movement. In order to mount the power steering system to the propulsion unit, special bracketry is required for each engine design., because the mounting pads vary markedly depending on the design. Exemplary of engine mounting is the disclosure in the above identified British Patent Application, where, as shown in FIG. 7, the power assist unit 120 is mounted on a propulsion unit 10, which is mounted to a boat transom 22. As the propulsion unit 10 tilts about the horizontal axis 42, the power asist unit 120 may come into contact with the boat transom, thereby limiting its applicability. A second disadvantage is that the power steering system, including the supply and return lines which are under high pressure, are subjected to sun rays, salt water corrosion, and physical abuse because of exposure. Thirdly, such designs as shown in the prior art do not allow for steering shock to be absorbed partially by the steering cable, in that any steering shock is prevented from passing beyond the power assist steering system causing a high stress on the propulsion unit steering components. Lastly, the systems of the prior art, and in particular such a system as taught by the aforesaid British Patent Application, are designed to continuously supply fluid to the system, and not just when steering movement occurs. This constant fluid supply system wastes propulsion engine horsepower.

U.S. Pat. No. 497,706 discloses an in-line steering assist system in that the system is mounted remote from the rudder disposed adjacent the propeller. A retractable carriage is moved by a fluid actuated piston, and a cable extending from the piston, around pulleys on the carriage and to the rudder disk, moves the disk in response to movement of the piston. Little or no torque created at the rudder is consumed by the steering assist means to thereby reduce the steering effort required at the helm.

The prior art also discloses a steering mechanism for a boat utilizing a gear assembly for steering the boat, typically the gear assembly actuates a steering member on the engine in response to the steering input at the steering wheel. This prior art includes U.S. Pat. Nos. 1,425,887; 1,852,151; 2,700,358; 2,891,498; 2,939,417; 3,181,491; 3,669,146; 4,416,637; 4,890,683; and 5,018,469. None of these references, however, incorporate a power steering assist mechanism with the gear assembly.

SUMMARY OF THE INVENTION

In accordance with the present invention, there is provided a power steering system for a marine vehicle, such as for an outboard, having a steering helm and propulsion unit pivotal about a steering axis. The power steering system comprising a power steering assist means interposed between the propulsion unit and the steering helm and mounted remote from the propulsion unit, and a gear drive means operably connected to the helm and the power steering assist means to effect actuating input to the power steering assist means upon actuation at the steering helm. Actuable output means is operably connected to the power steering assist means for operative movement in response to the actuating input. Actuable steering means is operably connected to the output and to the propulsion unit for providing actuable output to the propulsion unit to effect steering movement thereof about the steering axis. The steering helm typically includes a steering wheel and is operator actuable, and the gear drive means is operably connected at one end to the steering helm and at the opposed end to the power steering assist means, which is actuated in response to rotation of the steering wheel. The operable connection of the gear drive means to the power steering assist means includes a suitable actuating means for regulating the flow of hydraulic fluid through the power steering assist means. In a preferred embodiment, the actuable output means comprises a gear output means operably connected to the power steering assist means for operative movement in response to the actuation of the power steering assist means. Actuable steering means is operably connected at one end to the gear output means and responsive to operative movement of the gear output means for overcoming torque on the propulsion unit relative to the steering axis in response to actuable movement of said actuable steering means. At its opposed end, the actuable steering means is operably connected to the steering member of the propulsion unit for effecting common movement of the steering member in response to actuable movement of the actuable steering means upon steering actuation of the steering helm to pivot the propulsion unit about the steering axis.

It will be observed that the power steering assist means is interposed between the helm and the propulsion unit or engine and mounted remote from the propulsion unit, and as used herein and in the appended claims the term "interposed between" is not restricted to the actual physical arrangement, but rather to the operable arrangement in that, for example when viewed in plan, the helm optionally can be arranged between the other two members, but in fact the power steering assist means is the operably interposed member. Further, regardless of the apparent physical arrangement, the power steering assist means is mounted remote from the propulsion unit.

Broadly, the gear drive means includes an input driven gear operative in response to rotation of the steering shaft. The gear output means, as the preferred embodiment, comprises a first output gear operably connected to the input driven gear, and output driven gear operably engagable with the first output gear, and a second output gear operably connected to the output driven gear. Where desired, the actuable output means may comprise a hydraulic operated means. In a preferred embodiment, the input driven gear further includes an input driving gear operably connected to an input rack and pinion, which operably engages the actuating means. The input driving gear, rotatably mounted as on the steering shaft, effects translation of the input rack which in turn actuates the power steering assist means. For the gear output means, the first output gear includes a first rack and pinion operably responsive to the actuation of the power steering assist means, and preferably a second output rack and pinion operably connected to the first output rack and pinion to effect translation of the second output rack. The actuable steering means is operably connected to the second output rack, and lateral movement of this second rack then effects common movement of the steering member in response to steering at the helm.

Suitable actuable steering means may be mechanical, electrical or hydraulic, or a combination of any two. In a preferred embodiment of the invention, the actuable steering means is a mechanical push-pull cable arrangement comprising a flexible outer sheath or cover and an inner core axially slidable in the sheath. The sheath protects the core, and also helps in directing the cable and in preventing the cable from coiling. If a mechanical cable is utilized, the cable is operably connected at one end to the power steering assist means, and at the opposite end to the propulsion unit. Steering actuation at the helm actuates the cable, more specifically the inner core, to effect output at the power steering assist means and thereby effect common movement of the steering member. Also, a plurality of steering cables may be used to provide output such as for a large engine or where two or more engines are used for the boat. Where desired, a hydraulic system may be utilized as an actuable steering means. Typically, a hydraulic system comprises a cylinder and piston arrangement operably connected with the power steering assist means to effect output, and means for pumping pressurized fluid to one end of the cylinder to actuate the piston in response to steering movement at the helm. Steering movement at the helm effects common movement at the steering member to pivot the propulsion unit about a vertical steering axis.

The power steering assist means comprises a hydraulic cylinder-piston assembly, having a valve control means normally biased to a closed position., and a hydraulic fluid source means for providing pressurized hydraulic fluid to the cylinder-piston assembly. The fluid source means comprises an accumulator means for delivering hydraulic fluid to the cylinder-piston assembly, and a reservoir means for accepting hydraulic fluid directed from the cylinder-piston assembly and passing the fluid to the accumulator. Actuating means operably connected to the gear drive means and to the valve control means will, upon steering movement, actuate the valve control means to open fluid communication and provide for delivery of pressurized fluid through the cylinder-piston arrangement from the fluid source means, thereby simultaneously providing output to actuate the actuable steering means to effect common movement of the steering member. The actuating means selectively actuates the valve control means for a right turn direction or for a left turn direction, and this actuable movement is preset so that it is substantially equal for both turn directions. In the preferred embodiment, the valve control means comprises two spaced apart valve housings with the valve or valves biased to a closed position, and the actuating means opens the valves for one valve housing only depending on the steering direction, thereby directing the flow of pressurized hydraulic fluid. Pressurized hydraulic fluid delivered to the cylinder-piston assembly reciprocates the piston, and associated means operably connected to the piston actuates the output cable to effect common movement of the steering member.

The cylinder-piston assembly and fluid source means are supported by a suitable housing for mounting, and because the system is remote from the engine, the system can be mounted in a place which is protected from exposure to the elements and to physical abuse. Further, in accordance with a preferred embodiment, the actuating means includes suitable linking means operably connecting the gear drive means and the gear output means, which is free to reciprocate upon actuation of the steering means. A suitable ram extending from the piston in the cylinder-piston assembly is operably connected to the linking means and to the output gear means, which provides output to the actuable steering means. Also, the actuating means, which reciprocates upon steering actuation, includes means to adjust the travel distance of the actuating means so as to control the valve opening and thereby allowing for a desired or necessary increased rate of steering.

DESCRIPTION OF THE DRAWINGS

FIG. 4 is a side elevational view of the structure of FIG. 3.

FIG. 7 is a diagramatic representation of the gear arrangement utilized in the structure of the present invention.

FIG. 7A is a cross-sectional view on the line 7A-7A of FIG. 7.

FIG. 7B is a cross-sectional view on the line 7B-7B of FIG. 7.

FIG. 8 showing in detail the valve control means.

DETAILED DESCRIPTION AND PREFERRED EMBODIMENTS

Figure 1:
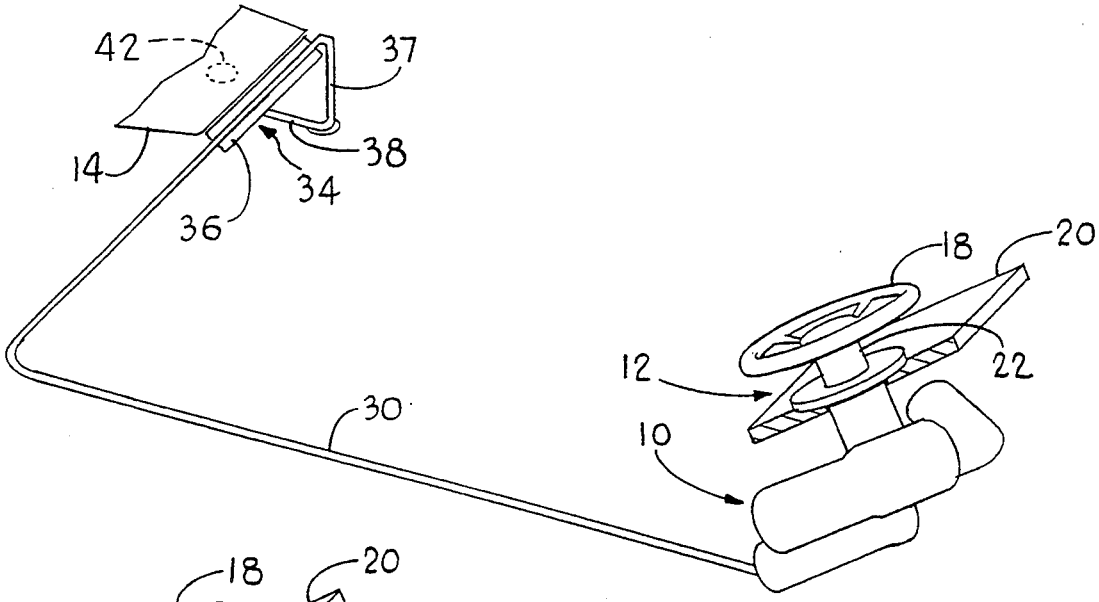
FIG. 1 is a schematic representation to show a steering arrangement utilizing the present invention for use in a marine vehicle.
Figure 1A:
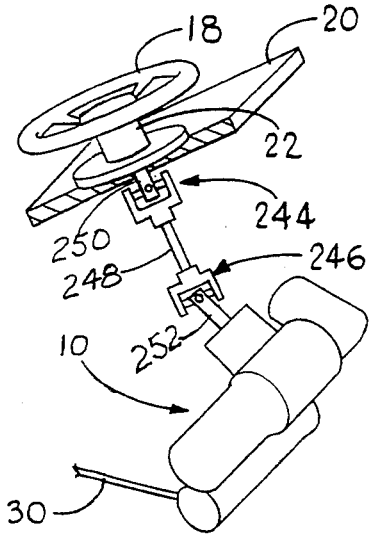
FIG. 1*a* is a schematic representation showing a steering system for a boat utilizing an alternative structure of the invention.
Figure 2:
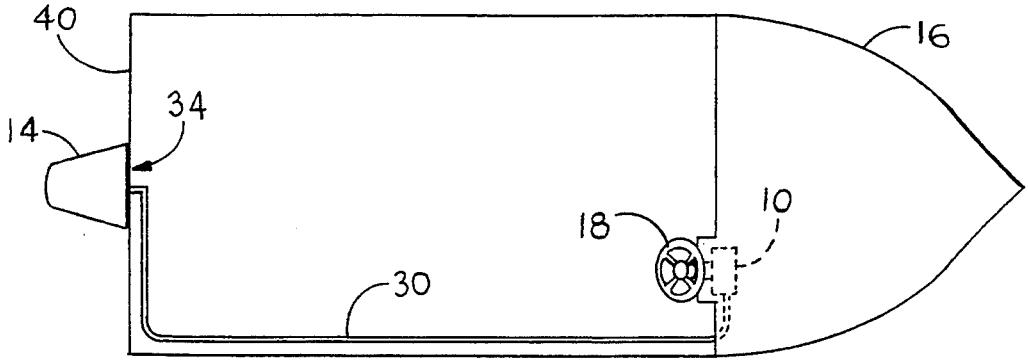
FIG. 2 is a diagramatic plan view of a boat utilizing the structure of the invention.

Referring to the drawings, wherein the same reference numerals refer to similar parts throughout the various views, there is shown diagramatically in FIGS. 1, 1*a* and 2 a power steering system of the present invention as mounted on a boat. In accordance with the present invention, the power steering system includes a power steering assist means, indicated generally by the numeral 10, operably interposed between the steering helm 12 and the propulsion unit 14 and mounted remotely from the propulsion unit. It should be understood that the power steering assist means need not be physically positioned between the helm and the propulsion unit, but the power steering assist means is in-line in that it completes the actuable connection between the helm and propulsion unit. Preferably, the power steering assist means 10 is mounted at or near the helm. As shown, the steering helm 12 is positioned at or near the fore of the boat hull 16, and typically includes a steering wheel 18 appropriately mounted in panel 20. Steering shaft 22 is secured at one end to wheel 18, and is rotatable upon rotation of the wheel. The shaft 22, having integrally formed end cap 23 extends from the steering wheel through mounting 24 and is operatively connected with input gear means indicated generally by the numeral 26 and described below in detail. This end of the shaft is connected with the input gear means for operative movement in response to rotation of the steering wheel. Thus, rotation of the wheel 18 in one direction or the other actuates the input gear drive means 26, which is operably connected to power steering assist means 10, comprising a hydraulic fluid pressure actuated means, described below in detail, and provides power steering assist in response to actuation of the gear drive means. It will be observed that this gear drive means accepts input from the steering helm, and transfers the input to the power steering assist means.

A second gear means or output gear means, indicated generally by the numeral 28 and described below in detail, is operably engagable with the power steering assist means 10 for operative movement in response to actuation of the power steering assist means. An actuable steering means indicated generally at 30, preferably comprising a push-pull cable having an outer sheath or cover 32 and inner core 33 which is slidably movable relative to the outer sheath, is operably connected at one end to the gear output means for actuation in response to operative movement of the gear output means. It will be observed that the actuable steering means 30 is at a position separate and removed from the input gear means 26, but operative movement of input gear means as a result of steering movement at the helm, actuates power steering assist means 10, which in turn operatively moves gear output means 28 thereby actuating the steering means 30. Thus, the actuable steering cable accepts output from the power steering assist means, and transfers the output to the propulsion unit, or, more specifically to the steering member of the propulsion unit. The actuable steering means 30 is actuably connected at its opposite end to steering member 34 of propulsion unit 14, which typically includes a tilt tube 36, steering link 37 and steering arm 38, and is mounted on transom 40 of boat hull 16 for pivotal movement about a vertical steering axis 42 (the steering axis envisioned as being substantially normal to the surface of the water). In this manner, actuation of the steering cable 30 effects steering movement of the propulsion unit.

The power steering assist means 10, which is mounted between the steering helm and propulsion unit and remotely from the propulsion unit, includes a hydraulic cylinder-piston assembly 44, having a valve control means indicated generally at numeral 46 (see FIGS. 3, 6, 8 and 9), and a fluid source means 48 spaced apart from and in fluid communication with said hydraulic assembly 44 for providing pressurized fluid to the hydraulic assembly. The steering assist means 10 is mounted preferably near or beneath the panel 20. (See FIGS. 1 and 3.) Tank member or reservoir 50, for holding hydraulic fluid, and pump 52, operated by motor 53, are disposed for fluid communication with said hydraulic cylinder-piston assembly 44 and fluid source means 48. An actuable linkage means extending from the power steering assist means 10 and operably connected to the gear output means 28, operates in conjunction with and upon actuation of steering wheel 12 to effect steering movement of the propulsion unit. Thus, when the hydraulic cylinder-piston assembly 44 is actuated in response to steering movement at the helm, pressurized hydraulic fluid, (e. g., pressurized oil) flows through the hydraulic assembly 44 delivered from the fluid source means 48, as described below in detail. Torque from the propulsion unit 14 is overcome by the power steering assist means 10 thereby reducing the effort at the steering wheel to only the effort required to operate the hydraulic cylinder-piston assembly 44, which is independent of the torque generated by the propulsion unit.

As best seen in FIGS. 3–7, there is shown gear input means 26 operably connected to the steering helm 12 through the steering shaft 22 and to the power steering assist means 10. In a preferred embodiment, gear input means 26 comprises an actuator gear or driving gear 54 having a generally cylindrical configuration with a bore 55 for coaxial mounting on one end of output shaft 56. The opposed ends of actuator gear 54 are provided with spaced apart radial teeth sections 58 and 60, and an interjacent planar section 62 having a slot 64 for accommodating stop means 66 protruding from output shaft 56, for reasons explained below. End cap 23 is provided with a conventional key means (not shown) suitable for engaging with teeth section 58 so that rotation of the steering shaft 22 rotates actuator gear 54. The opposed end of actuator gear 54 having radial teeth section 60 meshes with input drive gear 68 disposed axially on input shaft 70 spaced from and substantially parallel to the output shaft 56. At the opposed end of input shaft 70 is input rack and pinion comprising elongated bar rack 74 having a substantially circular cross-section with a flattened rack surface and pinion gear 76 disposed in meshing relationship with bar rack 74. Thus, for this input assembly of gear drive means, actuator gear 54 is rotatably mounted on output shaft 56 and engaged with steering shaft 22 at the end opposed to the connection of the steering shaft to the steering wheel 18, and turning the wheel 18 rotates shaft 22 which in turn rotates actuator gear 54.

Input drive gear 68 is disposed in operative engagement with actuator gear 54, each gear having radial teeth for meshing relationship. It will be observed that rotation of actuator gear 54 in either a clockwise or counterclockwise direction rotates input drive gear 68 in the opposite direction. Input drive gear 68 is connected or affixed to rotatable input shaft 70 which extends to pinion gear 76, and is operative in response to rotation of drive gear 68. Elongated rack 74 is disposed in meshing relationship with pinion 76, and is protected by housing 78. Rack 74 is connected at one end to actuator bracket 80, as with bolt 81, and it is preferable that the engagement periphery of the rack 74 with pinion 76 extend less than the full length of the rack because of this connection. Actuator bracket 80 is operably connected to the hydraulic cylinder-piston assembly 44, thereby establishing an operable connection between the steering helm and the hydraulic assembly and the hydraulic assembly and actuable steering means, as described and explained below in greater detail.

Figure 3:
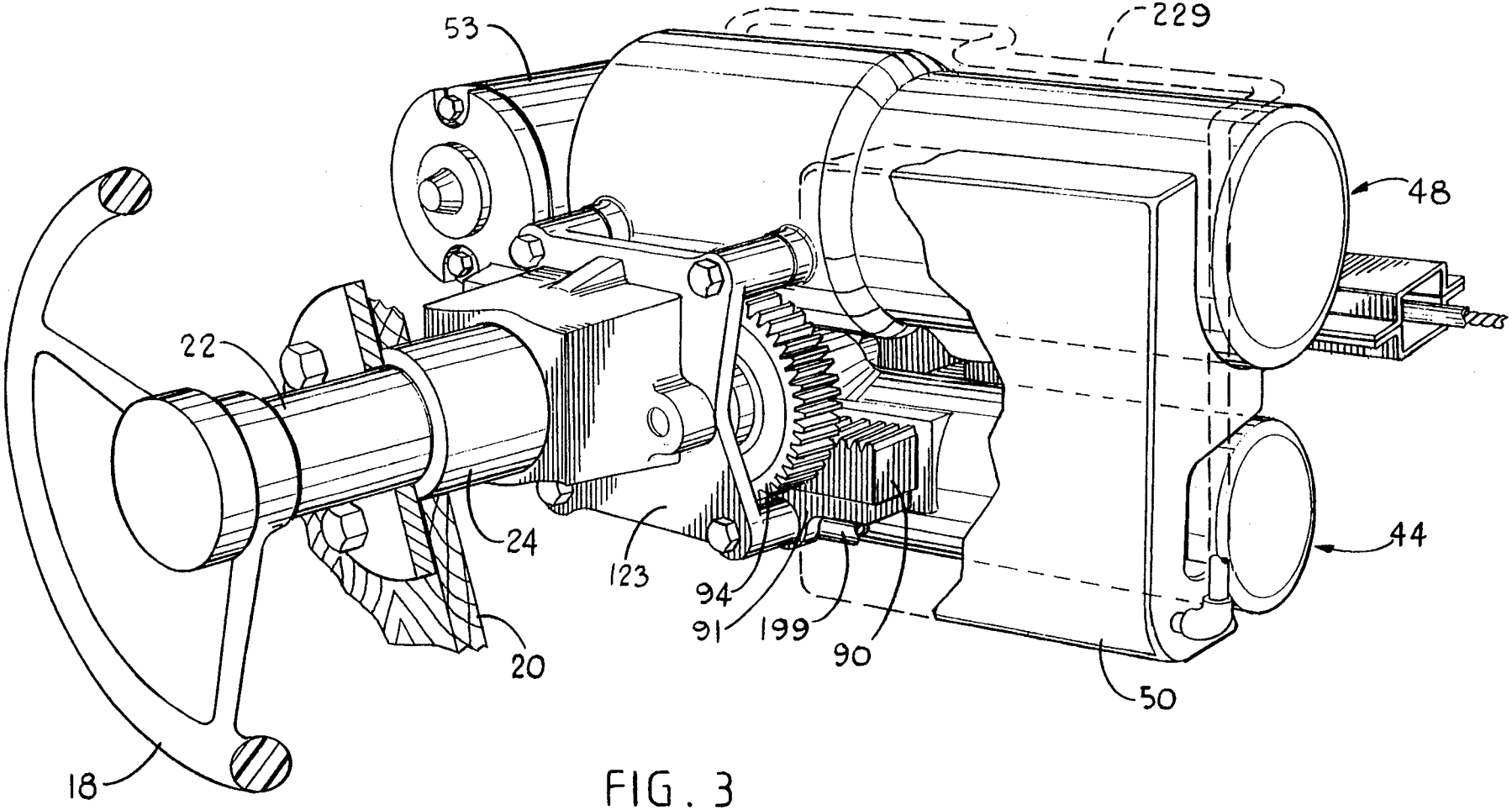
FIG. 3 is a perspective view of the power steering assist means of the present invention, with a portion broken away to better illustrate certain details.
Figure 5:
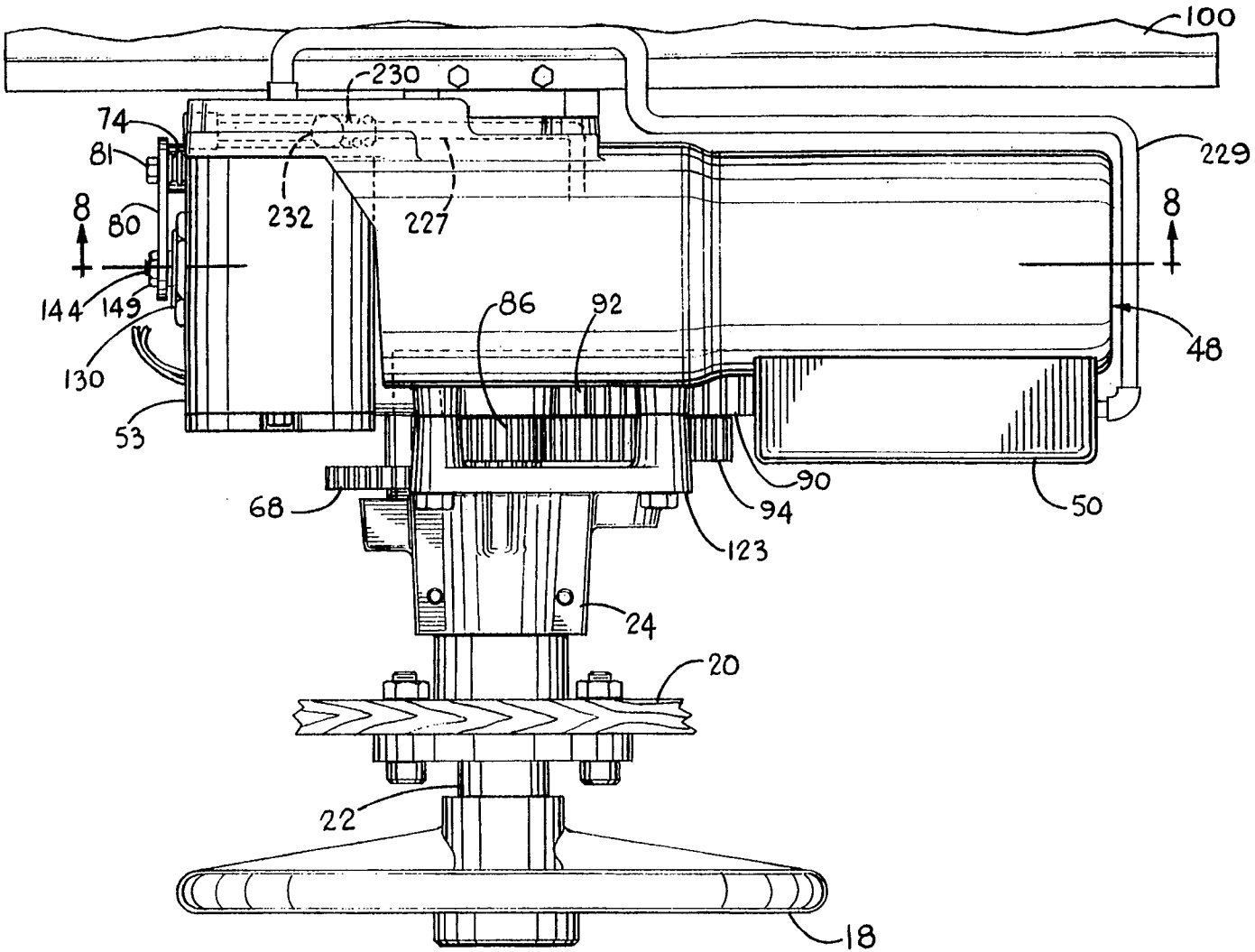
FIG. 5 is a plan view of the structure of FIG. 3.
Figure 6:
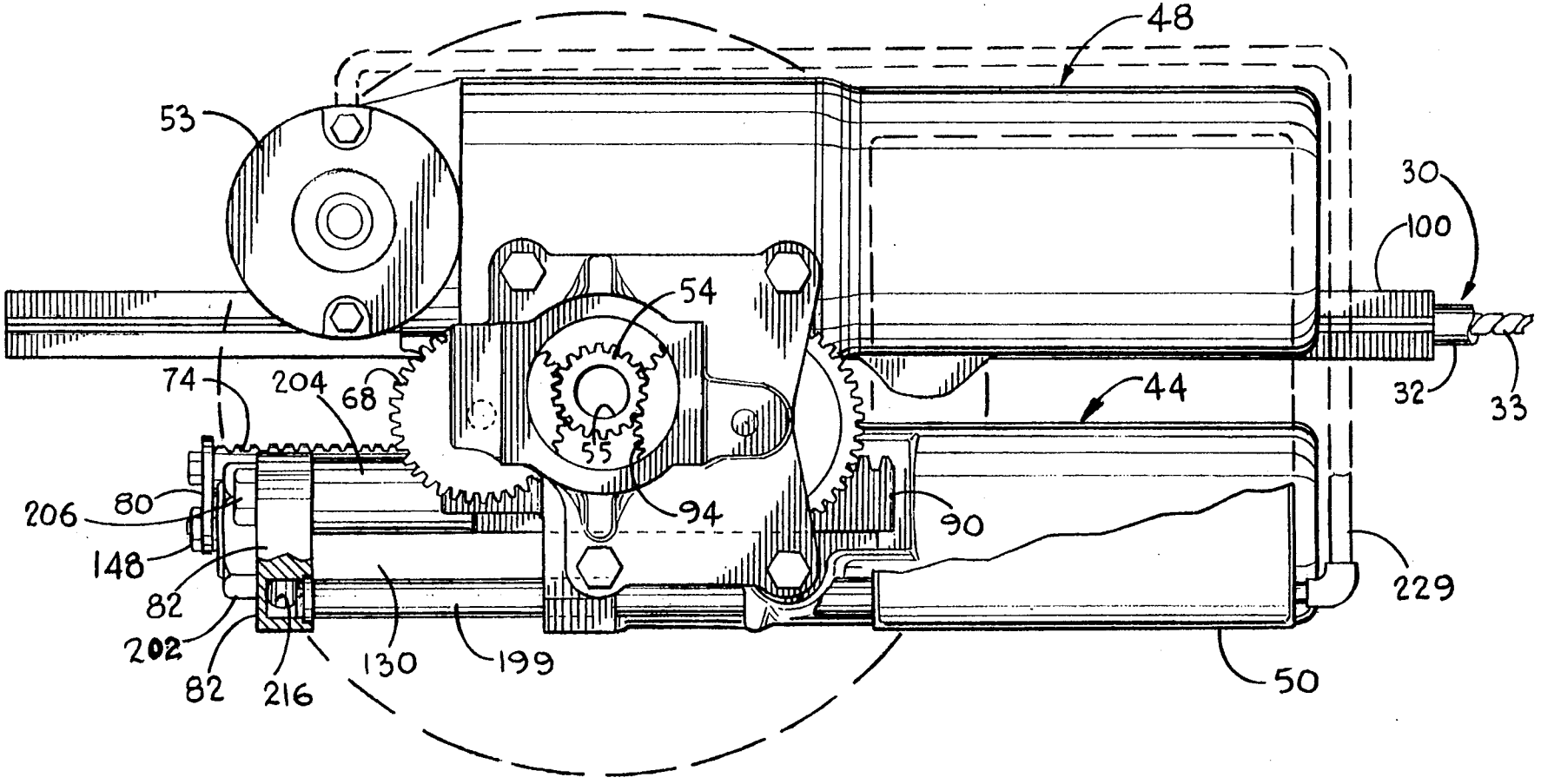
FIG. 6 is a front elevational view of the structure as shown in FIG. 5 with the steering wheel and steering shaft removed.

The reciprocal travel distance for actuator bracket 80 is predetermined or preset and this distance is short relative to the travel distance of the ram rod in the cylinder-piston assembly 44, as explained below, and therefore input bar rack 74 travels a corresponding distance when providing input or actuation to the actuator bracket. Reciprocal movement of the actuator bracket 80 actuates the valve control means 46 of the cylinder-piston assembly, including a reciprocating ram, and described below. As shown in the drawings (see FIGS. 4 and 11), output bracket 82 is operably connected to the ram of the cylinder-piston assembly 44 (described below), and to the gear output means 28. In a preferred embodiment, the gear output means comprises a first output rack and pinion indicated generally at 84 in operable engagement with an output shaft gear 86 which is operably connected to a second output rack and pinion indicated generally at 88. As best shown in FIGS. 3, 6, and 7, first output rack and pinion includes elongated bar rack 90 of substantially rectangular configuration, mounted for lateral movement on support 91, and is disposed for lateral movement upon corresponding reciprocal movement of the ram in cylinder-piston assembly 44 (described below). Pinion gear 92, which is disposed in meshing relationship with rack 90, and output gear 94, of larger diameter than gear 92, are coaxially mounted on shaft 96, so that upon lateral movement of rack 90, both gears 92 and 94 rotate together. Output shaft gear 86 is mounted or affixed near one end of output shaft 56 adjacent to actuator gear 54, and further output gear 94 is arranged in meshing relationship with output shaft gear 86. Thus, rotation of output gear 94 rotates output shaft gear 86, which in turn rotates output shaft 56.

Actuable steering means 30 is operably connected at one end to second output rack and pinion 88 in housing 100, comprising pinion gear 98 and an elongated rack 102 in meshing relationship with pinion 98. Thus, rotation of output shaft 56 in either a clockwise or counterclockwise direction moves the rack 102 in one direction or the other. Transverse movement of this rack actuates the steering means 30. In order that this second output rack 102 moves at a predetermined rate with respect to the first output rack 90, which is operably connected to the hydraulic cylinder-piston assembly 44 as described below, output gear 94 is in meshing relationship with output shaft gear 86. The output shaft 56, being driven by output gear 94, is operably connected to pinion 98 disposed in meshing relationship with rack 102, and therefore rack 102 moves in the same general direction as the direction of rotation of pinion 98, i.e., clockwise rotation of pinion 98 moves rack 102 to the right. It thus will be observed both first and second rack and pinion assemblies 84 and 88 operate substantially concomitantly, and that output racks 90 and 102 move at substantially the same ratio.

Where desired, the power steering system of the invention can incorporate more than one output rack and pinion 88. Hence, for a boat having two propulsion units, or for a boat having two steering cables, there is provided two output rack and pinions assemblies 88 and 88' as shown in FIGS. 4 and 7B, and actuable steering means 30 and 30' (e.g., steering cables) are connected to the rack and pinion assemblies. Thus, there is shown in FIG. 7B, pinion gear 98 mounted or affixed to the end of output shaft 56, and a second pinion gear 106 mounted in meshing relationship with gear 98. Elongated bar rack shown schematically as 107 is mounted transversely to the axis of gear 106 and in meshing relationship thereto. Thus, rotation of the output shaft rotates pinion 98, causing lateral translation of rack 102 and rotation of pinion 106 which moves rack 107. Although rotation of pinions 98 and 106 will be in opposite directions, the lateral movement of racks 102 and 107 will be in the same direction. .Actuation of the two steering means 30 and 30' then will be coincidental.

The hydraulic cylinder-piston assembly 44 includes a cylinder 108 having a bore 110 for accomodating reciprocating piston 112 mounted for reciprocating movement in bore 110. (See FIGS. 8 and 9.) The piston 112 includes end cap 114 forming the piston head and opposed to the ram end and is affixed to the piston and provided with openings 116, and an integrally formed plug 118 extending laterally from the end cap, is spaced from the cylinder end wall 120 thereby defining chamber 122 at one end of the cylinder for accommodating a hydraulic fluid, e.g. oil. At the opposed end of cylinder 108 is housing 123 for supporting the hydraulic cylinder-piston assembly and the fluid source means 46, and further includes spaced apart, transverse bores 124 and 125, to receive output shaft 56 and shaft 70, respectively.

Piston 112 is mounted for reciprocative movement in the bore 110 of cylinder 108, and is provided with appropriate sealing gaskets and bearings (not shown) to prevent fluid leakage along the outside surface of the piston. Further, piston 112 is provided with threaded annular recess 126, and threaded terminus 128 of tubular ram rod 130 is threadedly engaged with recess 126. Ram rod 130, concentrically arranged with and coaxially disposed along the longitudinal axis of cylinder 108 and spaced inwardly therefrom, extends longitudinally from piston 112 outwardly from the terminus of cylinder 108, and is slidably retained by housing 123 and fixedly connected at its terminus to actuator bracket 82. The ram rod 130 has a plurality of spaced apertures 132, for reasons more fully explained below, and further is provided with annular reduced portion of smaller diameter than the head diameter, and this reduced portion has a lateral or inwardly extending annular shoulder 134.

Ram rod 130 being substantially concentric with cylinder 108 cooperate therewith to define annular channel 140, which is in fluid communication with valve control means 46 through apertures 132. Annular ram rod 130 has an axial passageway or channel 142 relative to the longitudinal axis, and is in fluid communication with the valve control means 46, as described below.

Valve control means 46 includes reciprocating piston 112 mounted for reciprocal movement in bore 110 of cylinder 108. Actuator rod 144, having a reduced section 145 with annular shoulder 146, extends longitudinally from the valve control means 46 through channel 142, and is supported at the opposite end distal from the piston by bearing 147. The reduced section 145 extends through the bearing 147, and rod 144 is operably connected at threaded end 148 to actuator bracket 80 by means of adustment nut 149 (described in more detail below). The opposite threaded end 150 is threadedly engaged to valve control means 46. The piston end of ram rod 130 of enlarged diameter is provided with a longitudinal bore 152 which is substantially coaxial with channel 142, and extends from the interior facing of end cap 114 to define spacing or opening 154 and terminates outwardly therefrom at shoulder 134. Annular ball actuator 158, having an open-ended longitudinal bore 160, is mounted in bore 152 for reciprocative movement axially relative to the ram rod 130. The opposite end of ball actuator 158, extending outwardly into opening 156, is internally threaded at 162 for threaded engagement with threaded section 150 of actuator rod 144. Ball actuator 158 is provided with at least one and preferably a plurality of apertures 164 disposed inwardly (in the direction of shoulder 134) from threaded section 162 for establishing fluid communication between channel 142 and bore 160. Interposed between the apertures 164 and the terminus at opening 154 are spaced apart annular flanges 166 and 168, which extend transversely outwardly from the cylindrical wall of ball actuator 158 into chambers 170 and 172, respectively. Threaded end 150 of actuator rod 144 is externally threaded to threadedly engage threaded section 162 of ball actuator 158. Because actuator rod 144 is operably connected to ball actuator 158, when reciprocal movement of actuator rod 144 is caused by movement of actuator bracket 80, ball actuator 158 is moved axially relative to ram rod 130.

Figure 9:
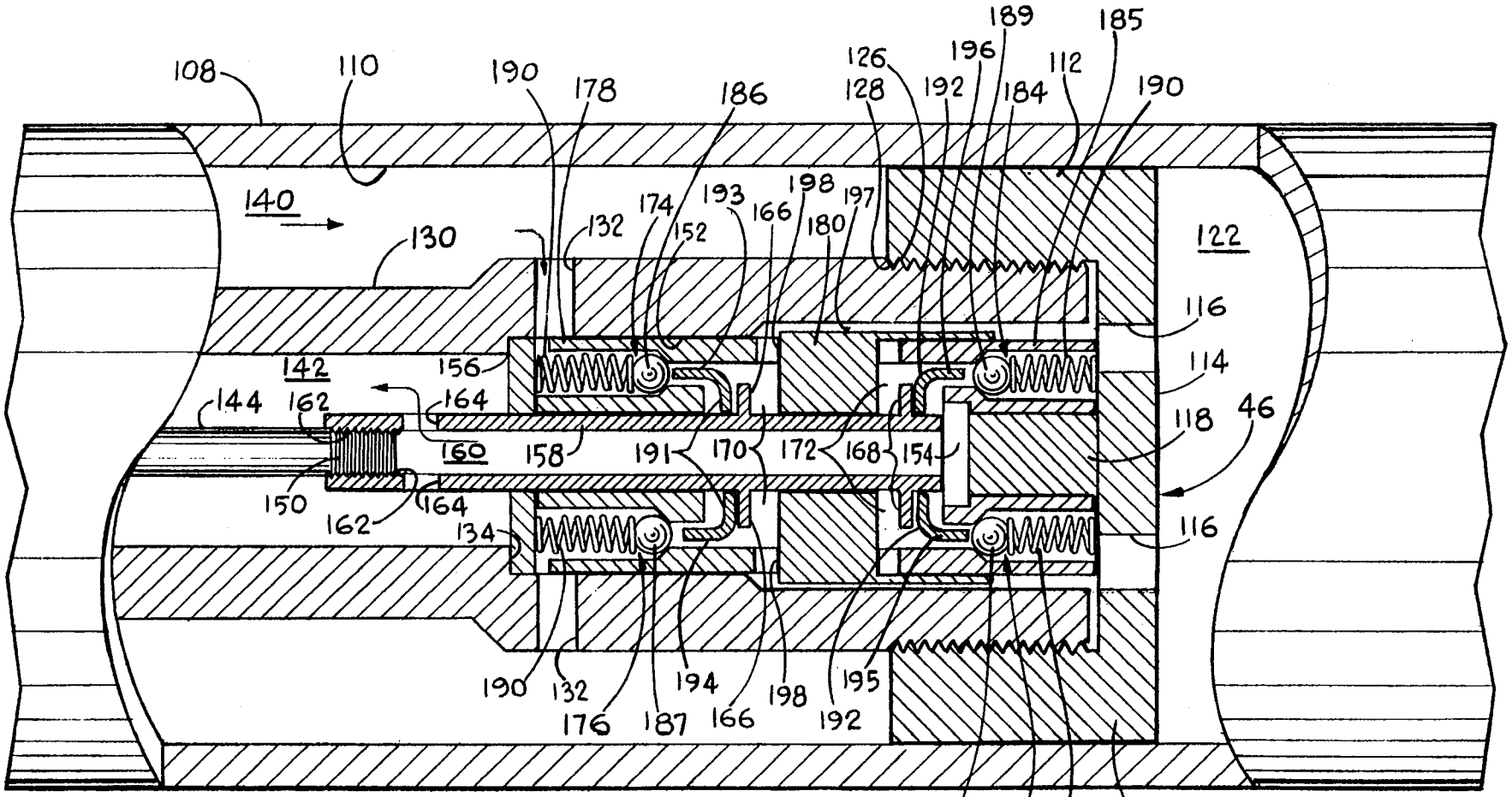
FIG. 9 is a cross-sectional view on line 9—9 of FIG.
Figure 10:
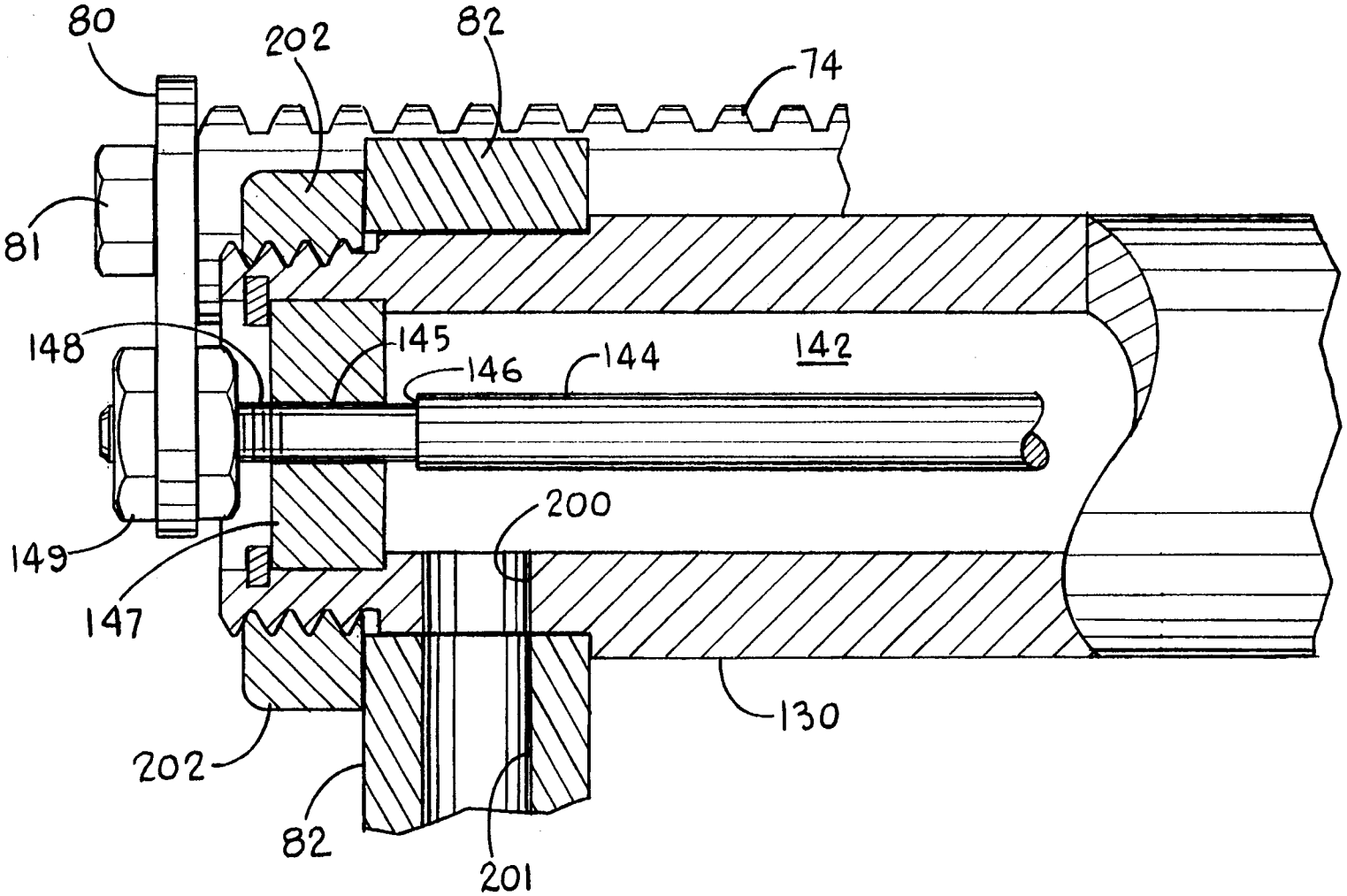
FIG. 10 is a cross-sectional view on line 10—10 of FIG. 8 showing in detail the actuating means.

As more clearly shown in FIG. 9, valve control means 46 further includes (a) ball check valves 174 and 176 disposed in valve body 178 for controlling the flow of pressurized hydraulic fluid delivered from the fluid source means 48 through a first fluid communication means to chamber 122 (described below), and, separated by divider 180, and (b) ball check valves 182 and 184 disposed in valve body 185 for controlling the flow of pressurized hydraulic fluid from chamber 122 through a second fluid communication means (described below). In this manner, the flow of hydraulic fluid, e. g. oil, is essentially in one direction only. As shown in the illustrated construction, each ball check valve has a check ball shown as check balls 186,187,188 and 189, and when in a no steering change position, each ball check valve is maintained in a closed position by suitable bias means 190, such as a coiled spring, which biases each ball against a cooperating seat so as to prevent the passage of oil through the ball check valve. In this position, the valve control means 46 is locked and cannot be moved. Ball actuator pins 191 and 192, preferably formed as an annular member or ring insertable on the ball actuator, has one or more transverse flanges or bosses 193, 194, 195 and 196 extending from the outer peripheral edge of the ring with the terminus spaced from the check ball when in a no steering change position. For each check ball there is a flange or boss member, and upon steering movement to the left or right, a boss is brought into contact with a check ball so as to unseat the ball. Upon axial movement of the ball actuator to the left or to the right, flange 166 or 168 engages an actuator pin 191 or 192 and forces a boss into engagement with with a check ball to move the check ball from its seat, thereby allowing for the flow of pressurized hydraulic fluid, e. g. oil, through the valve assembly, as explained below. Thus, it will be observed from FIG. 9 that when ball actuator 158 is moved to the left as by a left steering motion, pin 191 is moved to the left so that the bosses 193 and 194 engage check balls 186 and 187, thereby opening ball check valves 174, 176. Conversely, when ball actuator 158 is moved to the right as by a right steering motion, pin 192 is moved to the right so that the bosses 195 and 196 engage check ball 188 and 189, thereby opening ball check valves 182, 184. In a preferred embodiment, the boss 193 for pin 191 is longer than boss 194. As a consequence, upon axial movement of ball actuator 158, check ball 186 will be raised from its seat prior to, and without unseating check ball 187, and check ball 187 will be unseated to provide for an increased flow of pressurized hydraulic fluid for a left turn position only to increase the rate of turn, if required, of the actuation of the power steering assist system. Similarly, boss 195 for pin 192 is longer than boss 196, and therefore check ball 188 is opened first, and check ball 189 is opened to increase the rate of turn for a right turn.

Ram rod 130 includes annular channel. 197 extending between ball check valves 174 and 176 and orifice 116 for supplying pressurized hydraulic fluid, e. g. oil, to chamber 122. Thus, annular channel 140 of cylinder 108 is in fluid communication with the valve body via ball check valves 174 and 176 through apertures 132 in the side wall of ram rod 130. When one or both of these valves is opened upon actuation of ball actuator 158 (e.g., steering is to the left, and therefore the ball actuator is reciprocated to the left as viewed in FIG. 9), fluid communication continues from chamber 170 via orifice or opening 198 to annular channel 197 extending longitudinally through ram rod 130, and then to orifice 116 in the end cap 114 of piston 112 and opening to chamber 122. It will be observed that pressurized fluid entering chamber 122 forces piston 112 to the left. In this manner, hydraulic fluid such as oil delivered from fluid source means 48 flows through the piston and into chamber 122, thereby completing a first fluid communication means between the fluid source means and chamber 122. The pressurized fluid flowing from chamber 122 and returning to fluid source means 48 flows through the ram rod 130 in an essentially different flow path. End cap orifice 116 opens in part to ball check valves 182 and 184, which in turn open to chamber 172 and then to opening 154 fluid communicating with bore 160 which is in fluid communication with axial channel 142 through apertures 164. Thus, when one or both ball check valves 182, 184 is opened upon actuation of ball actuator 158 in the opposite direction from that described above (e.g., to the right), communication means for permitting the flow of hydraulic fluid is established between chamber 122, through ball check valves 182 and 184, opening to bore 160 of the ball actuator, which in turn opens to axial channel 142. The opposite end of axial channel 142 is in fluid communication with return line 190 via aligned passageways 200 and 201 in ram rod 130 and output bracket 82, respectively, and terminating at oil tank 50, and from the tank to fluid source means 48, as explained below in detail. The depletion of hydraulic fluid in chamber 122 causes the piston 112, and consequently the ram rod 130, to move to the right, thereby completing a second fluid communication means between chamber 122 and fluid source means 48.

As explained above, ram rod 130, disposed concentrically with and inwardly spaced from cylinder 108, extends from piston 112 where it is fixedly attached at the ram end, and is slidably retained by bore 209 in housing 123 having a suitable bearing surface to accommodate the reciprocating rod. At its opposite end, the ram rod is fixedly attached to output bracket 82 as by threaded engagement with nut 202. Further, actuator bracket 80 is operably connected to actuator rod 144 which, in turn, is operably connected at its opposed end to ball actuator 158, such that upon steering actuation at the helm to actuate the gear assemblies, these elements (i.e., actuator rod, actuator bracket and ball actuator) reciprocate or move in unison thereby opening one or the other of the ball check valves 174, 176 or 182, 184 to permit the flow of hydraulic fluid through the cylinder-piston assembly 44.

In a preferred embodiment as shown in FIGS. 7, 8, 9 and 10, adjustment nut 149 is screw threaded onto the threaded section 148 of actuator rod 144 at the opposed surfaces of the actuator bracket 80. The length of engagement, which in actual practice can vary for each power steering apparatus because of machine tolerances, provides for a predetermined travel distance for the actuator bracket 80. This travel distance is equal to a full unseating of both ball check valves 182,184 (for a right turn), at which point the side wall of slot 64 in planar section 62 engages stop means 66, thereby actuating output shaft 56. Rotation of shaft 56, which is in operably engagement with gear output means 28, will cause manual activation of ram rod 130 in the direction and rate of travel relative to actuator bracket 80. Thus, for a no steering change position, adjustment nut 149 is set to a predetermined position and locked in place. When steering is to the right, actuator rod 144 begins moving to the right to open one or both ball check valves 182, 184 and permit the flow of hydraulic fluid, e. g. oil, through valve control means 46 via the second fluid communication means described above, and, if the turn speed is increased, will move the complete travel distance until the stop means 66 abuts the wall of slot 64, thereby stopping any further movement of the actuator rod 144 and causing manual steering. Conversely, when steering is to the left, actuator rod 144 begins moving to the left to open one or both ball check valves 174, 176 to permit the flow of hydraulic fluid into valve control means 46 via the first fluid communication means described above, and, if the turn speed is increased, will move the complete travel distance until stop means 66 abuts the opposite wall of slot 64, thereby stopping any further movement of the actuator rod. At this point, slot 66 in planar section of actuator gear 54 engages stop means 66 causing manual steering.

Figure 11:
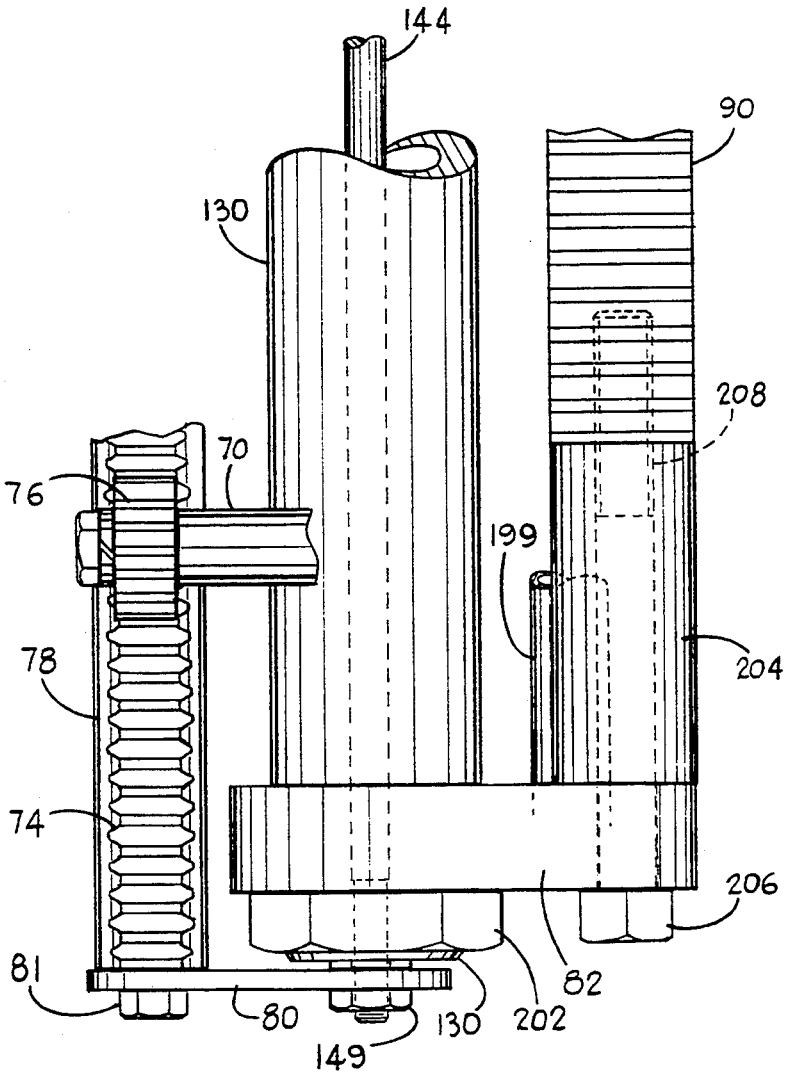
FIG. 11 is a diagramatic representation showing in more detail the actuating means in operable connection with the gear arrangement.

Output bracket member 82 is operably connected to annular ram rod 130, and reciprocates in unison or in common with the reciprocative movement of the ram rod 130. (See FIGS. 6, 8, and 11.) Further, output bracket 82 is also operably connected to bar rack 90 (of first output rack and pinion 84), which therefore will move laterally upon reciprocal movement of the ram rod. As best shown in FIG. 11, it is preferable to utilize a spacer 204 between the bracket member 82 and gear rack 90, which members are then connected by such means as bolt 206, having a threaded section 208, extending longitudinally through the spacer and into a threaded bore 209 in the gear rack. As explained above, actuating first output rack and pinion 84 rotates output shaft gear 86 which in turn effects actuation of second output rack and pinion 88. The bar rack 102 is adapted to receive one end of the inner core 33 of steering means 30 for axial movement, and said end of core 33 is operably connected to the rack 102 so as to reciprocate in common with the lateral movement of the rack. The opposite end of the inner core 33 is operably connected to steering member 34 of the propulsion unit 14. It thus will be observed that actuation of ram rod 130 actuably reciprocates output bracket 82, and by means of gear output assembly 28, actuates steering means 30, thereby effecting common movement of the steering member 34 in response to the steering actuation at the helm 12 to pivot the propulsion unit 14 about the steering axis 42.

In a preferred embodiment, the rate of travel for the ram rod 130 and the first output rack 90 are substantially equal, that is, are in a ratio of about 1:1. Output gear 94, however, is larger in diameter than pinion gear 92 and also output shaft gear 86, and the linear travel ratio of the second output rack 102 to the first output rack 90 is greater than 1, and preferably this ratio is about 2:1. By reason of this travel relationship between racks, it is possible to reduce the overall size of the complete assembly.

Figure 8:
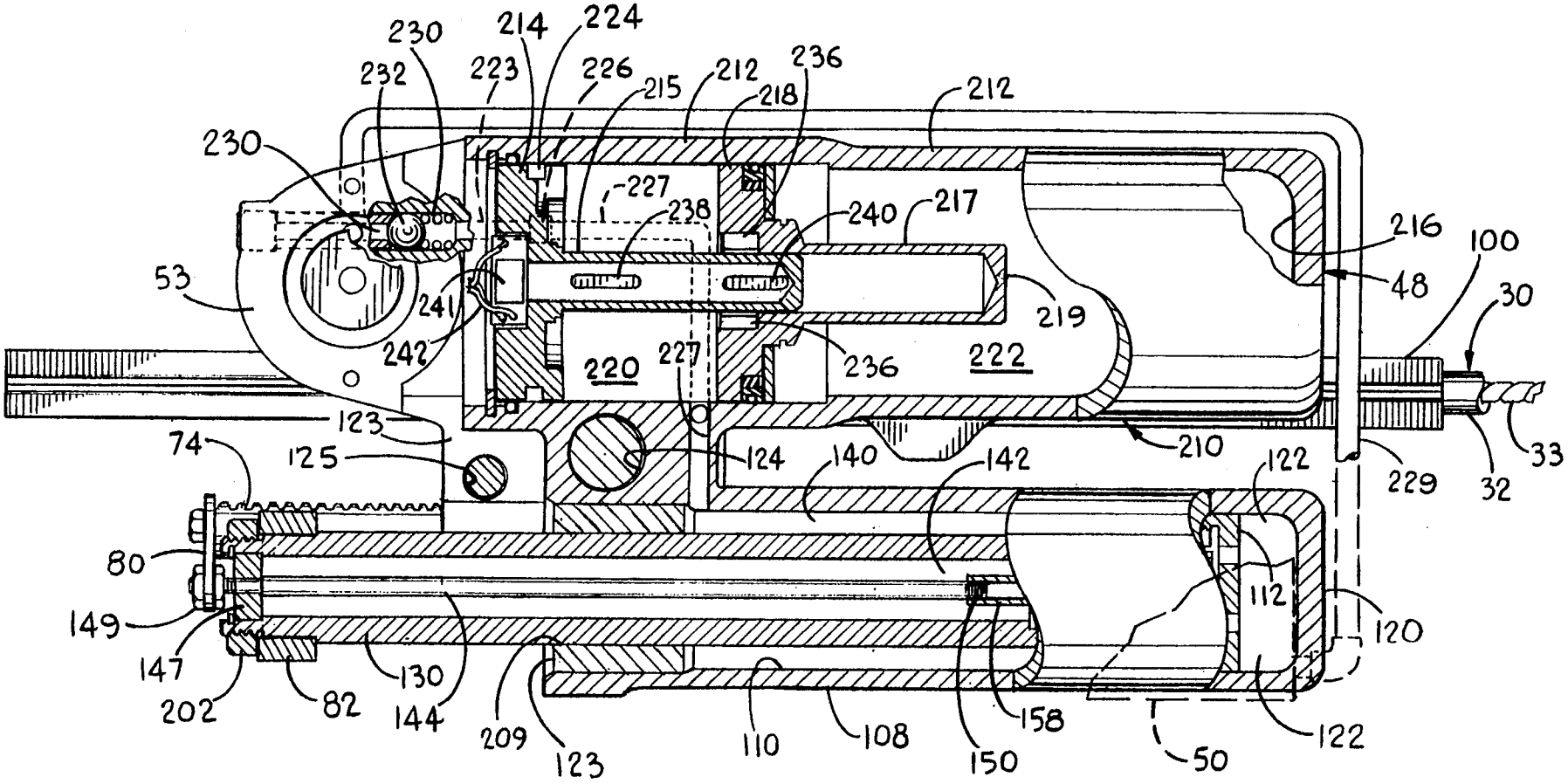
FIG. 8 is a cross-sectional side view of the structure of FIG. 6.

Referring now in particular to FIG. 8, there is shown fluid source means 48 having a cylinder-piston accumulator 210 comprising cylinder 212 closed at one end with wall 216 and at the opposite end by end cap 214. Piston 218 is mounted for reciprocal movement in cylinder 212 which divides the cylinder into chambers 220 and 222. Tubular member 215 extends axially from end cap 214, and coaxial tubular extension 217 of piston 218, projecting into chamber 222 and having a closed end 219, is adapted for slidably receiving member 215, and this reciprocal slidable movement on member 215 inhibits wobble of the piston as it reciprocates in the cylinder chamber. Housing 123 is provided with a fluid passageway 223 that opens to circumferential passageway 224 in cap 214 having slotted peripheral opening 226 to provide fluid communication with chamber 220. A second fluid passageway or bore 227 in housing 123 establishes fluid communication with annular passageway 140 in cylinder 108, thereby completing first fluid communication means extending from chamber 220 in fluid source means 48 to chamber 122 in hydraulic cylinder-piston assembly 44. Pump 52 is disposed adjacent the accumulator 210, and the pump is operated by electric motor 53 having a suitable power source such as a battery or by generator (not shown). The pump receives hydrulic fluid via second return line 229, and cooperably with tank member 50 and pump 52 provide a reservoir means for the hydraulic fluid. Conduit 230, having check valve 232, leads from the pump to the cylinder chamber 220 in the cylinder-piston accumulator 210. Hydraulic fluid, e. g. oil, is delivered to the pump via return line 229. The check valve 232, which prevents hydraulic fluid from returning to the pump, that is fluid flows in one direction only from the pump to the cylinder chamber 220, is normally closed. Piston 218 moves reciprocally within cylinder 212 in response to hydraulic fluid entering chamber 220 through conduit 230 or leaving chamber 220 through passageway 227. Piston 218 is biased to a fluid delivery position by pressurized gas contained in the second chamber 222, such gas being typically nitrogen under a pressure of from about 800 to 1200 pounds per square inch. Thus, in the illustrated emodiment, hydraulic fluid is forced from chamber 220 by the pressure exerted on the piston by the gas in chamber 222 as by a left or right turn thereby actuating the actuator rod 144 to open one or both ball control valves. When ball control valves 174, 176 are opened, the pressurized hydraulic fluid passes from chamber 220 to chamber 122 via the first fluid communication means comprising passageway 227, annular channel 140, apertures 132, ball check valves 174, 176, opening 198, annular channel 197, and aperture 116. Conversely, when ball check valves 182, 184 are opened, pressurized hydraulic fluid passes from chamber 122 and is returned to tank 50 via conduit 199, and then to the pump 52 via return line 229. When hydraulic fluid is pumped into chamber 220, piston 218 moves against the pressurized gas in chamber 222. This second fluid communication means comprises aperture 116, ball check valves 182,184, opening 154, bore 160, aperture 164, axial channel 142, through aperture 200, through channel 201 in output bracket 82, and then to return line 199, tank 50, and then second return line 229 to pump 52.

A suitable switch means, which are of conventional construction and well known in the art, is preset to operate the motor 53 for pumping the hydraulic fluid, e.g. oil, through check valve 232 into chamber 220. When fluid is pumped into chamber 220, piston 218 is moved against the pressurized gas in chamber 222. A suitable switch means comprises a magnetic ring 236 carried by piston 218 and sensors 238 and 240 connected to a solenoid 241 wired to a power source (not shown.) by wires 242. As the piston reciprocates to predetermined positions, magnetic ring 236 trips the sensors 238 and 240 to start or stop the motor 53 for pumping hydraulic fluid such as oil. In the illustrated embodiment as shown in FIG. 8, the piston 218 is essentially to the right of the midpoint of its travel. As hydraulic fluid in chamber 220 is depleted and the piston 218 moves to the left, magnetic ring 236 trips sensor 238 to start the motor. Fluid then is pumped into chamber 220 thereby moving piston 218 against the gas pressure until magnetic ring trips sensor 240 and turns off the motor 53.

In operation, which is described as using oil as the pressurized hydraulic fluid, the power assist steering means will operate in response to the steering movement at the helm by the operator. Assuming first that steering is to be to the left, that is the steering wheel is central and the propulsion unit is in a no-turn change position and the wheel is turned for a left turn movement, the helm actuates the gear input means 26, as explained above. The power steering assist means 10, which is operably connected to the gear output means 28 through the output bracket 82, is actuated upon movement of actuator bracket 80 to the left.

Flange 166, depending from the ball actuator 158, is positioned such that upon reciprocal movement contacts or abuts acutautor pin 1.91 and thereby forces open valves 174, 1.76 by unseating check balls 186 and 187 normally biased to a closed position by springs 190. Movement to the left by acutator bracket 80 relative to the output bracket 82 moves actuator rod 144 to the left thereby forcing the boss of ball actuator pin 191 to the left and against the ball valves. In the preferred embodiment, boss 193 is longer than boss 194, and initially check ball 186 only is unseated from its cooperating valve seat. The opening of valve 174 allows pressurized oil to flow from chamber 220 through the first fluid communication means comprising passageway 227 opening to annular channel 140, through apertures 132 and ball check valve 174, through opening 198, then to a second annular channel 197, and through apertures 116 and into chamber 122. Thus, the pressurized oil entering chamber 122 exerts a pressure on the piston 112 thereby moving it to the left along with ram rod 130 and output bracket 82. If the actuator bracket 80 is kept in the same position relative to output bracket 82, the steering rate will remain constant. If the steering rate has to be increased, the actuator bracket 80 will move a still greater distance to the left relative to the output bracket 82. This reciprocative movement of the actuator bracket will move check ball 186 further from its seat to permit an increase in the flow of oil from chamber 220 thereby increasing the steering rate. If the rate is still insufficient, the actuator bracket 80 is moved further to the left relative to the output bracket, which further actuates the actuator rod 144 and moves ball actuator further to the left. This movement brings boss 194, the shorter boss, into contact with check ball 187 to unseat the check ball and open the valve 176. With both valves open, the flow of pressurized oil from chamber 220 through the first fluid communication means into chamber 122 is increased. If the relative position of actuator bracket 80 to output bracket 82 is returned to its original position, check balls 186 and 187 are returned to their respective seats by reason of spring means 190 thereby blocking the flow of oil and stopping the steering movement.

When oil is delivered to chamber 122 from chamber 220 of the fluid source means 48, piston 112 is moved to the left. Thus, when the valves 174, 176 have been opened by a steering actuation, the force exerted on piston 218 by the pressurized gas in chamber 222 moves piston 218 to the left and thereby drives oil from chamber 220 to chamber 122 via the first fluid communication means. When the piston 218 reaches a predetermined position the magnetic ring 236 trips sensor 238, which turns on the motor 53 and starts the pump 52 to pump oil into chamber 220 via check valve 232. As the oil is pumped, additional oil enters the pump reservoir through the inlet line 229 from the oil tank 50. Oil entering chamber 220 moves the piston 218 to the right against the gas pressure in chamber 222. The check valve prevents oil from returning to the pump. When the piston 218 reaches a predetermined position, the magnetic ring trips sensor 240, which turns off the motor.

Where desired, the steering shaft may include one or more universal joints, which are conventional in steering assemblies. As shown in FIG. 1A, two universal joints 244 and 246 are interposed between the steering helm and the power steering system, and the two universal joints are connected by rod 248. A driving shaft 250 extends from the steering helm to universal joint 244, and a driven shaft 252 extends from the second universal joint 246 to the gear drive means.

Figure 12:
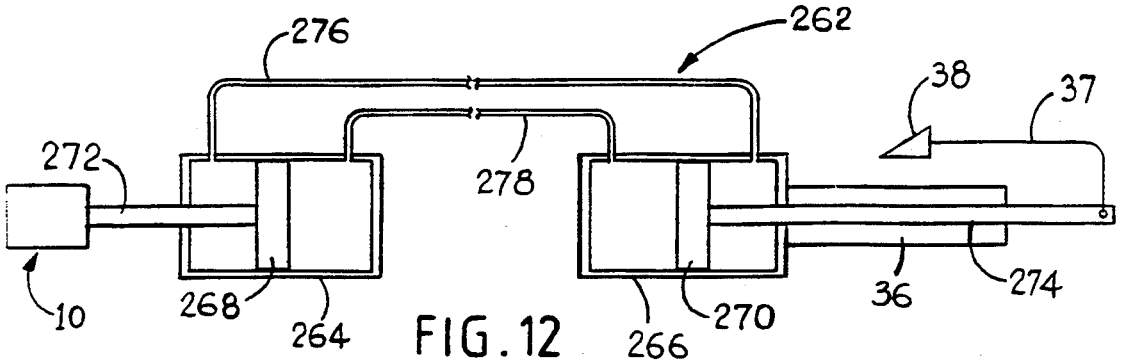
FIG. 12 is a schematic representation of still another alternative steering means for use at the propulsion unit.

If hydraulic fluid actuable steering means is utilized at the output end, as shown in the alternative embodiment in FIG. 12, a dual cylinder-piston assembly 262 of essentially identical construction is utilized. Cylinder 264 desirably is mounted to support means 208, and cylinder 266 desirably is mounted on or near the propulsion unit, and each cylinder includes a reciprocating piston 268 and 270 thereby defining opposed chambers for each cylinder. Where desired, cylinder 264 may be of larger diameter than cylinder 266, so that the stroke of cylinder 264 is less than the stroke for cylinder 266 but would still achieve full travel distance at the steering member. Piston rod 272, extending from piston 268 outwardly from cylinder 264, is actuably connected to the power steering assist means as by output bracket 82, explained above. Piston rod 274 extends from piston 270, through tilt tube 36, and is operably connected at its opposite end to steering link 37 which actuates steering arm 38. Conduits 276 and 278 transport hydraulic fluid between cylinders 264 and 266 in opposite directions upon steering actuation. Thus, when steering actuation moves the piston rod 272 to the left, as shown in FIG. 12, piston 268 moves to the left and forces hydraulic fluid from one chamber of cylinder 264 to one chamber of cylinder 266, and thereby reciprocates piston rod 274 to the left to effect steering movement to the left. As the piston 270 moves to the left, oil is forced from the other chamber of cylinder 266 to the opposed chamber of cylinder 264. Similarly, steering to the right effects the flow of hydraulic fluid in an opposite direction.

The foregoing detailed description has been given for clearness of understanding only, and no unnecessary limitations should be understood therefrom, as modifications will be obvious to those skilled in the art.

What is claimed is:

1. A power steering system adaptable for a marine vehicle having a propulsion unit pivotal about a steering axis, actuable steering means for applying torque to said propulsion unit to effect steering movement thereof about said steering axis, an operator actuable steering helm and a steering member connected to said propulsion unit, said steering helm including a steering shaft operable upon steering actuation; said system comprising: gear drive means operably connected to said steering shaft for operative movement in response to said steering actuation; power steering assist means interposed between said steering helm and said propulsion unit and mounted remote from said propulsion unit, and actuated in response to operative movement of said gear drive means to provide actuating input to said power steering assist means; actuable output means operably connected to said power steering assist means for operative movement in response to said actuating input and operably connected to the actuable steering means, thereby actuating the actuable steering means in response to operative movement of said actuable output means for overcoming torque on said propulsion unit relative to said steering axis in response to actuation of said actuable steering means, said actuable steering means providing actuable output to effect common movement of said steering member in response to said steering actuation to pivot said propulsion unit about said steering axis.

2. A power steering system in accordance with claim 1 wherein said actuable steering means comprises a push-pull cable having a flexible sheath and inner core axially slidable in said sheath, said inner core of said cable having a first end operably connected to said actuable output means for overcoming torque on said propulsion unit relative to said steering axis in response to axially slidable movement of said inner core of said cable, and said inner core of said cable having a second end operably connected to said steering member for effecting common movement of said steering member in response to axial slidable movement of said inner core of said cable upon steering actuation of said steering helm to pivot said propulsion unit about said steering axis.

3. A power steering system according to claim 1 wherein said gear drive means includes input driven gear operative in response to rotation of said steering shaft; and said actuable output means includes (a) first output gear operably connected to said input driven gear, (b) output driven gear operably engagable with said first output gear, and (c) second output gear operably connected to said output driven gear.

4. A power steering system in accordance with claim 1 wherein said gear drive means includes input rack and input pinion, said input pinion rotatably operative in response to rotation of said steering shaft, and said input rack disposed in operative engagement with said input pinion for transverse movement in response to rotation of said input pinion, and means extending from said input rack for operably engaging said actuable output means.

5. A power steering system in accordance with claim 4 wherein said gear drive means further includes driving gear means operably connected to said steering shaft and to said input pinion to rotate said input pinion in response to rotation of said steering shaft.

6. A power steering system in accordance with claim 5 wherein said driving gear means comprises an input driving gear rotatably mounted on said steering shaft, an input driven gear in operative engagement with said input driving gear, and a rotatable drive shaft extending from said input driven gear to said input pinion to rotate said input pinion in response to rotation of said input driving gear.

7. A power steering system according to claim 1 wherein said actuable output means comprises a gear output means.

8. A power steering system according to claim 7 including linking means extending from said power steering assist means movable in response to actuation of said power steering assist means, said gear output means comprising a first output rack and pinion, said first output rack operably connected to said linking means for corresponding movement upon movement of said linking means, said first output pinion rotatably mounted and in operative engagement with said first output rack, and a rotatable output driven gear operably connected to said first output pinion.

9. A power steering system according to claim 8 further including an intermediate output gear rotatably mounted for common rotation with said first output pinion and in operative engagement with said output driven gear.

10. A power steering system according to claim 8 wherein said gear output means further includes a second output rack and pinion operably connected with said output driven gear to effect transverse movement of said second output rack in response to rotation of said output driven gear, and means for operably connecting said actuable steering means to said second output rack.

11. A power steering system according to claim 10 further including an intermediate output gear rotatably mounted for common rotation with said first output pinion and in operative engagement with said output driven gear, said intermediate output gear of larger diameter than said first output pinion, and the linear travel ratio of said said second output rack to said first output rack is greater than one.

12. A power steering system according to claim 11 wherein said linear travel ratio is about two or greater.

13. A power steering system according to claim 10 including a rotatable shaft operably connecting said output driven gear with said second output pinion, whereby rotation of said output driven gear rotates said second output pinion to effect translation of said second output rack.

14. A power steering system according to claim 10 and further including a third output pinion disposed for operative engagement with said second output pinion, a third output rack disposed in operative engagement with said third output pinion to effect transverse movement of said third output rack in substantially the same direction as said second output rack, and including means for operably connecting a second actuable steering means to said third output rack.

15. A power steering system according to any one of claims 8-14 wherein said linking means includes a first bracket means operably connected to said first output rack for reciprocative movement on an axis generally coinciding with the linear travel of said first output bracket and including means for adjusting the reciprocative movement distance in both directions of said first bracket means, and a second bracket means operably connected to said power steering assist means and to said gear output means and mounted for reciprocative movement upon actuation of said power steering assist means.

16. A power steering system according to any one of claims 1-14 wherein said power steering assist means includes a hydraulic fluid cylinder-piston assembly having cylinder with an open end, a reciprocally mounted piston in said cylinder, an annular ram rod having a central bore extending coaxially in said cylinder from said piston through said open end of said cylinder and mounted for reciprocative movement, valve control means disposed in said cylinder-piston assembly adapted to establish fluid communication to said cylinder-piston assembly to effect reciprocative movement of said piston, a rod member having opposed ends extending coaxially of said central bore and operably connected at a first end to said valve control means, and actuating means including linking means operably connected to said gear drive means and to said rod member and responsive to said steering actuation for effecting common movement of said steering member.

17. A power steering system according to claim 16 including linking means having a first bracket means mounted for reciprocative movement on an axis generally coinciding with the axis of said rod member and including means for adjusting the reciprocative travel distance in both directions of said first bracket means, and a second bracket means operably connected to said ram rod outwardly from said open end of said cylinder and to said gear output means.

18. A power steering system according to any one of claims 10–14 further including means for manual steering upon failure of said power steering assist means, comprising a rotatable shaft operably connecting said first output gear with said second output pinion, coupling means for engaging said input driving gear with said rotatable shaft upon steering actuation to effect translation of said second output rack.

19. A power steering system according to any one of claims 1–14 wherein said steering shaft includes at least one universal joint, a driving shaft extending from said steering helm to said universal joint, and a driven shaft extending from said universal joint to said gear drive means.

20. A power steering system in accordance with any one of claims 1, 2, 8, 9, 10, 11, 12, 13 or 14 wherein said gear drive means includes an input driving gear operably connected to said steering shaft and rotatable in response to rotation of said steering shaft; an input driven gear in operative engagement with said input driving gear; an input rack and pinion, said input pinion operably connected to said input driven gear and rotatable in response to rotation of said steering shaft, and said input rack disposed in operative engagement with said input pinion for transverse movement in response to rotation of said input pinion; a rotatable drive shaft extending from said input driven gear to said input pinion to rotate said input pinion in response to rotation of said input driving gear; and means extending from said input rack for operably engaging said actuable output means.

21. A power steering system according to claim 20 including linking means extending from said power steering assist means movable in response to actuation of said power steering assist means, said actuable output means comprising a first output rack and pinion, said first output rack operably connected to said linking means for corresponding movement upon movement of said linking means, said first output pinion rotatably mounted and in operative engagement with said first output rack; an intermediate output gear rotatably mounted for common rotation with said first output pinion; a second output rack and pinion operably connected to said intermediate output gear to effect transverse movement of said second output rack in response to rotation of said intermediate output gear; a rotatable shaft operably connecting said intermediate output gear with said second output pinion; and said actuable steering means operably connected to said second output rack.

22. A power steering system in accordance with claim 21 wherein said power steering assist means includes a hydraulic cylinder-piston assembly having a cylinder with an open end, a reciprocally mounted piston in said cylinder, an annular ram rod having a central bore extending coaxially in said cylinder from said piston through said open end of said cylinder and mounted for reciprocative movement, valve control means disposed in said cylinder-piston assembly adapted to establish fluid communication to said cylinder-piston assembly to effect reciprocative movement of said piston, a rod member having opposed ends extending coaxially of said central bore and operably connected at a first end to said valve control means, and actuating means including linking means operably connected to said gear drive means and to said rod member and responsive to said steering actuation for effecting common movement of said steering member.

23. A power steering system according to claim 22 including linking means having first bracket means mounted for reciprocative movement on an axis generally coinciding with the axis of said rod member and including means for adjusting the reciprocative travel distance-in both directions of said first bracket means, and said second bracket means is operably connected to said ram rod outwardly from said open end of said cylinder and to said gear output means.

24. A power steering system according to any one of claims 1 2, 3, 4, 5, 6 or 7 including linking means extending from said power steering assist means movable in response to actuation of said power steering assist means, actuable output means comprising a first output rack and pinion, said first output rack operably connected to said linking means for corresponding movement upon movement of said linking means, said first output pinion rotatably mounted and in operative engagement with said first output rack; an intermediate output gear rotatably mounted for common rotation with said first output pinion; a second output rack and pinion operably connected to said intermediate output gear to effect transverse movement of said second output rack in response to rotation of said intermediate output gear; and a rotatable shaft operably connecting said intermediate output gear with said second output pinion.

25. A power steering system as in any one of the claims 1–14 wherein said power steering assist means includes a hydraulic fluid cylinder-piston assembly, hydraulic fluid source means including means for delivering pressurized hydraulic fluid to said cylinder-piston assembly, fluid communication means for providing communication between said cylinder-piston assembly and said fluid source means, valve control means disposed in said cylinder-piston assembly biased to a closed position for a no steering change position and adapted to establish fluid communication between said cylinder-piston assembly and said fluid source means, and actuating means to control the flow of hydraulic fluid delivered from said fluid source means and to selectively actuate said valve control means to establish said fluid communication upon steering actuation, whereby hydraulic fluid is delivered from said hydraulic fluid source means to said hydraulic fluid cylinder-piston assembly.

26. A power steering system according to claim 25 wherein said gear drive means includes an input driving gear operably connected to said steering shaft and rotatable in response to rotation of said steering shaft; an input driven gear in operative engagement with said input driving gear; an input rack and pinion, said input pinion operably connected to said input driven gear and rotatable in response to rotation of said steering shaft, and said input rack disposed in operative engagement with said input pinion for transverse movement in response to rotation of said input pinion; a rotatable drive shaft extending from said input driven gear to said input pinion to rotate said input pinion in response to rotation of said input driving gear; and means extending from said input rack for operably engaging said gear output means.

27. A power steering system according to claim 25 including linking means extending from said power steering assist means movable in response to actuation of said power steering assist means, said actuable output means comprising a first output rack and pinion, said first output rack operably connected to said linking means for corresponding movement upon movement of said linking means, said first output pinion rotatably mounted and in operative engagement with said first output rack; an intermediate output gear rotatably mounted for common rotation with said first output pinion; a second output rack and pinion operably connected to said intermediate output gear to effect transverse movement of said second output rack in response to rotation of said intermediate output gear; a rotatable shaft operably connecting said intermediate output gear with said second output pinion; and means for operably connecting said actuable steering means to said second output rack.

28. A power steering system according to claim 3, claim 7 or claim 26 including linking means extending from said power steering assist means movable in response to actuation of said power steering assist means, gear output means comprising a first output rack and pinion, said first output rack operably connected to said linking means for corresponding movement upon movement of said linking means, said first output pinion rotatably mounted and in operative engagement with said first output rack; an intermediate output gear rotatably mounted for common rotation with said first output pinion; a second output rack and pinion operably connected to said intermediate output gear to effect transverse movement of said second output rack in response to rotation of said intermediate output gear; a rotatable shaft operably connecting said intermediate output gear with said second output pinion; and means for operably connecting said actuable steering means to said second output rack.

29. A power steering system for a marine vehicle having operator steering actuation and adaptable for mounting remote from the propulsion unit of the vehicle, comprising: gear drive means operative in response to said steering actuation; a hydraulic cylinder-piston assembley having a cylinder with an open end, a piston mounted in said cylinder and reciprocally operative in response to operative movement of said gear drive means, an annular ram rod having a central bore extending coaxially in said cylinder from said piston through said open end of said cylinder and mounted for reciprocative movement upon reciprocal movement of said piston; hydraulic fluid source means including means for delivering pressurized hydraulic fluid to said cylinder-piston assembly; fluid communication means for providing communication between said cylinder-piston assembly and said fluid source means; valve control means disposed in said cylinder-piston assembly biased to a closed position for a no steering change position and adpated to establish fluid communication between said cylinder-piston assembly and said fluid source means; a rod member having opposed ends extending coaxially of said central bore and operably connected at a first end to said valve control means; actuating means to control the flow of hydraulic fluid delivered from said fluid source means, said actuating means operably connected to said rod member at its second end and to said ram rod to selectively actuate said valve control means to establish said fluid communication upon steering actuation; gear output means operably connected to said actuating means and including means for operably connecting said gear output means to said actuable steering means.

30. A power steering system according to claim 29 wherein said cylinder of said hydraulic cylinder-piston assembly further having a closed end, pump means in fluid communication with said hydraulic fluid source means, said annular ram rod operably connected to said piston end and concentrically arranged in said cylinder to define an annular channel in fluid communication with said fluid source means, means for closing said annular channel, a cylinder chamber defined by said cylinder closed end and said piston head, said rod member coaxially mounted for reciprocal movement in said central bore, first fluid communications means for establishing fluid communication between said hydraulic fluid source means and said chamber and including said annular channel and said valve control means, and second fluid communication means for establishing fluid communication between said chamber and said pump means and including said valve control means and said central bore, whereby flow of hydraulic fluid is in one direction only.

31. A power steering system according to claim 29 or claim 30 wherein said valve control means comprises a substantially cylindrical valve housing disposed in said ram rod, said valve housing having a longitudinal bore substantially coaxial with the axis of said ram rod and in fluid communication with said central bore of said ram rod, said actuating means operably connected to said valve housing, said valve housing having first and second valves spaced apart along the longitudinal axis of said valve housing, means to bias said first and second valves to a closed position, said first fluid communication means including said first valve, and said second fluid communication means including said second valve.

32. A power steering system according to claim 29 or claim 30 wherein said fluid source means further comprises an accumulator assembly including a cylinder and piston reciprocally mounted in said cylinder, spaced apart end cap and end wall for said accumulator cylinder, a first chamber in said accumulator cylinder defined by said end cap and said accumulator piston for containing hydraulic fluid, a second chamber defined by said accumulator piston and said end wall, fluid passageway in said end cap providing fluid communication between said pump means, said first chamber, and said annular channel, and pressurized nitrogen contained in said second chamber to bias said accumulator piston against hydraulic fluid in said first chamber.

33. A power steering system adaptable for a marine vehicle having a propulsion unit pivotal about a steering axis, steering means for applying torque to said propulsion unit to effect steering movement thereof about said steering axis and including an operator actuable steering helm and an actuable steering member connected to said propulsion unit; which comprises: gear drive means including an input driven gear operably connected to said steering helm and actuated in response to steering actuation at said steering helm; power steering assist means interposed between said steering helm and said propulsion unit and mounted remote from said propulsion unit and hydraulically actuated in response to operative movement of said gear drive means; said power steering assist means comprising a hydraulic cylinder-piston assembly having a piston reciprocally mounted in said cylinder, hydraulic fluid source means including means for delivering pressurized hydraulic fluid to said cylinder-piston assembly, fluid communication means for providing communication between said cylinder-piston assembly and said fluid source means, valve control means disposed in said cylinder-piston assembly biased to a closed position for a no steering change position and adapted to establish fluid communication between said cylinder-piston assembly and said fluid source means, actuating means operably connected to said cylinder-piston assembly and to said gear drive means to control the flow of hydraulic fluid delivered from said fluid source means and to selectively actuate said valve control means to establish said fluid communication upon steering actuation, whereby hydraulic fluid is delivered from said hydraulic fluid source means to said hydraulic fluid cylinder-piston assembly; gear output means including a first output gear operably connected to said actuating means and to said input driven gear, an output driven gear operably engageable with said first output gear, and a second output gear operably connected to said output driven gear and including means for operable connection to the actuable steering means, thereby actuating the actuable steering means for overcoming torque on said propulsion unit relative to said steering axis in response to actuation of said actuable steering means, said actuable steering means providing actuatable output to effect common movement of said steering member in response to steering actuation of said steering helm to pivot said propulsion unit about said steering axis.

* * * * *